US007342500B2

(12) United States Patent
Ho et al.

(10) Patent No.: US 7,342,500 B2
(45) Date of Patent: Mar. 11, 2008

(54) COMPACT MICROSTRIP TRANSPONDER ANTENNA

(75) Inventors: Thua Van Ho, Mississauga (CA); Wai-Cheung Tang, Mannheim (CA)

(73) Assignee: Mark IV Industries, Corp. (CA)

( * ) Notice: Subject to any disclaimer, the term of this patent is extended or adjusted under 35 U.S.C. 154(b) by 139 days.

(21) Appl. No.: 11/388,737

(22) Filed: Mar. 24, 2006

(65) Prior Publication Data

US 2007/0222607 A1 Sep. 27, 2007

(51) Int. Cl.
*G08B 13/14* (2006.01)

(52) U.S. Cl. ..... 340/572.7; 340/572.1; 340/928; 340/933; 342/42; 343/700 R; 343/742; 705/13

(58) Field of Classification Search ..... 340/572.7, 340/572.1, 572.4, 572.8, 928, 933, 10.42; 342/42; 343/700 R, 742; 705/13
See application file for complete search history.

(56) References Cited

U.S. PATENT DOCUMENTS

| | | | | |
|---|---|---|---|---|
| 4,104,630 A | | 8/1978 | Chasek | |
| 4,303,904 A | | 12/1981 | Chasek | |
| 4,870,419 A | | 9/1989 | Baldwin et al. | |
| 4,937,581 A | | 6/1990 | Baldwin et al. | |
| 5,086,389 A | | 2/1992 | Hassett et al. | |
| 5,132,687 A | | 7/1992 | Baldwin et al. | |
| 5,144,553 A | | 9/1992 | Hassett et al. | |
| 5,164,732 A | | 11/1992 | Brockelsby et al. | |
| 5,196,846 A | | 3/1993 | Brockelsby et al. | |
| 5,253,162 A | | 10/1993 | Hassett et al. | |
| 5,266,947 A | | 11/1993 | Fujiwara et al. | |
| 5,274,392 A | * | 12/1993 | D'Hont et al. | 343/866 |
| 5,289,183 A | | 2/1994 | Hassett et al. | |
| 5,310,999 A | | 5/1994 | Claus et al. | |
| 5,351,187 A | | 9/1994 | Hassett | |
| 5,424,727 A | | 6/1995 | Shieh | |
| 5,425,032 A | | 6/1995 | Shloss et al. | |
| 5,485,520 A | | 1/1996 | Chaum et al. | |
| 5,602,375 A | | 2/1997 | Sunahara et al. | |
| 5,640,156 A | | 6/1997 | Okuda et al. | |
| 5,657,008 A | | 8/1997 | Bantli | |
| 5,675,342 A | | 10/1997 | Sharpe | |
| 5,701,127 A | | 12/1997 | Sharpe | |
| 5,717,410 A | * | 2/1998 | Ohmine et al. | 343/771 |

(Continued)

FOREIGN PATENT DOCUMENTS

| | | |
|---|---|---|
| EP | 0 333 679 | 9/1989 |

(Continued)

OTHER PUBLICATIONS

U.S. Appl. No. 11/409,897, filed Apr. 24, 2006, Woo et al.

(Continued)

*Primary Examiner*—Davetta W. Goins
(74) *Attorney, Agent, or Firm*—Hanley, Flight & Zimmerman, LLC

(57) ABSTRACT

A transponder formed on a circuit substrate having a longitudinal axis and a transverse axis. An antenna is disposed on one side of a transverse axis, extending in a longitudinal direction, and the remaining circuit components are disposed on the other side of the transverse axis. The remaining circuit components may include a controller, an RF transceiver, and a battery. A ground plane defines an antenna space within which the antenna is disposed.

20 Claims, 3 Drawing Sheets

U.S. PATENT DOCUMENTS

| | | | | |
|---|---|---|---|---|
| 5,748,106 | A | 5/1998 | Schoenian et al. | |
| 5,751,973 | A | 5/1998 | Hassett | |
| 5,771,021 | A | 6/1998 | Veghte et al. | |
| 5,777,565 | A | 7/1998 | Hayashi et al. | |
| 5,805,082 | A | 9/1998 | Hassett | |
| 5,819,234 | A | 10/1998 | Slavin et al. | |
| 5,831,547 | A | 11/1998 | Ohtsuki et al. | |
| 5,841,866 | A | 11/1998 | Bruwer et al. | |
| 5,850,191 | A | 12/1998 | Yagi et al. | |
| 5,857,152 | A | 1/1999 | Everett | |
| 5,859,415 | A | 1/1999 | Blomqvist et al. | |
| 5,940,006 | A | 8/1999 | MacLellan et al. | |
| 5,963,149 | A | 10/1999 | Nagura et al. | |
| 6,025,799 | A | 2/2000 | Ho et al. | |
| 6,085,805 | A | 7/2000 | Bates | |
| 6,121,880 | A | 9/2000 | Scott et al. | |
| 6,191,705 | B1 | 2/2001 | Oomen et al. | |
| 6,219,613 | B1 | 4/2001 | Terrier et al. | |
| 6,616,034 | B2 | 9/2003 | Wu et al. | |
| 6,661,352 | B2 | 12/2003 | Tiernay et al. | |
| 6,725,014 | B1 | 4/2004 | Voegele | |
| 6,864,829 | B2 * | 3/2005 | Bervoets et al. | 342/46 |
| 6,898,753 | B2 | 5/2005 | Bonifas | |
| 2001/0050922 | A1 | 12/2001 | Tiernay et al. | |
| 2006/0071816 | A1 | 4/2006 | Tang et al. | |
| 2006/0082470 | A1 | 4/2006 | Zhu et al. | |

FOREIGN PATENT DOCUMENTS

| | | |
|---|---|---|
| JP | 10-105753 | 4/1998 |
| WO | WO 99/33027 | 1/1999 |

OTHER PUBLICATIONS

U.S. Appl. No. 11/409,741, filed Apr. 24, 2005, Woo et al.
U.S. Appl. No. 11/437,236, filed May 19, 2006, Tang et al.
U.S. Appl. No. 11/284,277, filed Nov. 21, 2005, Tang et al.
U.S. Appl. No. 11/176,758, filed Jul. 7, 2005, Ho et al.
U.S. Appl. No. 11/054,520, filed Feb. 9, 2005, Tang.
U.S. Appl. No. 11/098,257, filed Apr. 4, 2005, Zhu.
U.S. Appl. No. 11/176, 758, Unpublished, Wu.
Ching et al., *A Laser Micromachined Multi-Modal Resonating Power Transducer for Wireless Sensing Systems*, Sensors and Actuators A 97-98 (2002) 685-690, http://www.elsevier.com.
Finkenzeller, Klaus, *Ch. 3: Fudamental Operating Principles, RFID Handbook: Fundamentals and Applications in Contactless Smart Cards and Identification*, Klaus Finkenzellar, (2003) John Wiley & Sons, Ltd. ISBN 0-470-84402-7.
Sorrells, *Passive RFID Basics*, AN680, Michrochip Technology Inc., (1998) DS00680B.
Woo et al., Dual Mode Electronic Toll Collection Transponder, U.S. Appl. No. 11/409,897, filed Apr. 24, 2006.
Woo et al., Open Road Vehicle Emissions Inspection, U.S. Appl. No. 11/409,741, filed Apr. 24, 2006.
Jeffrey Zhu, System and Method for Secure Mobile Commerce, U.S. Appl. No. 10/912,997, filed Aug. 16, 2004.
Tang et al., Method and System for Obtaining Traffic Information Using Transponders, U.S. Appl. No. 11/284,277, filed Nov. 21, 2005.
Ho et al., Dynamic Timing Adjustment in an Electronic Toll Collection System, U.S. Appl. No. 11/176,758, filed Jul. 7, 2005.
Tang, RF Transponder with Electromechanical Power, U.S. Appl. No. 11/054,520, filed Feb. 9, 2005.
Zhu, U.S. Phase Modulation for Backscatter Transponders, U.S. Appl. No. 11/098,257, filed Apr. 4, 2005.
Tang et al., Method of Enabling Two-State Operation of Electronic Toll Collection System, U.S. Appl. No. 11/437,236, filed May 19, 2005.

* cited by examiner

COMPACT MICROSTRIP TRANSPONDER ANTENNA

FIELD OF THE INVENTION

The present invention relates to radio frequency (RF) transponders and, in particular, to RF transponders for use in an electronic toll collection system.

BACKGROUND OF THE INVENTION

Electronic toll collection systems conduct toll transactions electronically using RF communications between a vehicle-mounted transponder (a "tag") and a stationary toll plaza transceiver (a "reader"). An example of an electronic toll collection system is described in U.S. Pat. No. 6,661,352 issued Dec. 9, 2003 to Tiernay et al., and owned in common with the present application. The contents of U.S. Pat. No. 6,661,352 are hereby incorporated by reference.

In a typical electronic toll collection (ETC) system, the reader broadcasts a wakeup or trigger RF signal. A transponder on a vehicle passing through the broadcast area or zone detects the wakeup or trigger signal and responds with its own RF signal. The transponder responds by sending a response signal containing information stored in memory in the transponder, such as the transponder ID number. The reader receives the response signal and may conduct an electronic toll transaction, such as by debiting a user account associated with the transponder ID number. The reader may then broadcast a programming RF signal to the transponder. The programming signal provides the transponder with updated information for storage in its memory. It may, for example, provide the transponder with a new account balance.

In ETC systems, a number of lane-based reader antennas are deployed, often on an overhead gantry. Each of the lane-based reader antennas has a radiation pattern within the roadway. Similarly, each of the transponders has a radiation pattern. As a vehicle-borne transponder traverses a toll area, the respective radiation patterns of the reader antennas and the transponder define a capture zone in which the reader and transponder are capable of sending and receiving RF communications with each other.

In existing ETC systems, the timing of operations and decision-making are partly defined by the size of the capture zone. Accordingly, any modifications to transponders that are intended for use in existing ETC systems preferably provide a radiation pattern resulting in a similar size capture zone, even if achieving improvements in power-usage, sensitivity, etc.

SUMMARY OF THE INVENTION

The present application describes a transponder formed on a circuit substrate having a longitudinal axis and a transverse axis. An antenna is disposed on one side of a transverse axis, extending in a longitudinal direction, and the remaining circuit components are disposed on the other side of the transverse axis. The remaining circuit components may include a controller, an RF transceiver, and a battery. A ground plane defines an antenna space within which the antenna is disposed.

In one aspect, the present invention provides a transponder for use in an electronic toll collection (ETC) system. The transponder operates using radio frequency (RF) signals. The transponder includes a circuit substrate having a longitudinal axis and having a transverse axis perpendicular to the longitudinal axis, a ground plane formed on the circuit substrate, and a planar antenna formed on the circuit substrate. It also includes an RF transceiver connected to the antenna for receiving RF signals from the ETC system and for sending RF signals to the ETC system, a controller for controlling the RF transceiver, and a battery for supplying DC power to the controller and the RF transceiver. The antenna is disposed on one side of the transverse axis and the controller, the battery, and the RF transceiver are disposed on the other side of the transverse axis. The antenna is arranged in an antenna pattern, and the ground plane includes at least three connected segments and is disposed on at least three sides of the antenna pattern.

In a further aspect, the present invention provides a transponder for use in an ETC system. The transponder includes a circuit substrate having a longitudinal axis and having a transverse axis perpendicular to the longitudinal axis, a ground plane formed on the circuit substrate, and a planar antenna formed on the circuit substrate, wherein the antenna is disposed along an antenna axis, and wherein the antenna axis extends parallel to the longitudinal axis. The transponder also includes an RF transceiver connected to the antenna for receiving RF signals from the ETC system and for sending RF signals to the ETC system, a controller for controlling the RF transceiver in accordance with an ETC communications protocol, and a battery for supplying DC power to the controller and the RF transceiver. The antenna is disposed on one side of the transverse axis and the controller, the battery, and the RF transceiver are disposed on the other side of the transverse axis. The antenna is arranged in an antenna pattern, and the ground plane includes at least three connected segments and is disposed on at least three sides of the antenna pattern.

In yet a further aspect, the present invention provides a transponder for use in an ETC system. The transponder includes a circuit substrate having a longitudinal axis and having a transverse axis perpendicular to the longitudinal axis, a ground plane formed on the circuit substrate and defining an antenna space having ground segments on at least three sides, and a meander-line antenna formed on the circuit substrate within the antenna space and having a longitudinal antenna axis. It also includes a plurality of circuit components mounted on the circuit substrate for implementing an ETC communications protocol. The circuit components are connected to the antenna for receiving the RF signals, demodulating the RF signals, and exciting the antenna to propagate a response signal. The antenna is disposed on one side of the transverse axis and the plurality of circuit components are disposed on the other side of the transverse axis.

Other aspects and features of the present invention will be apparent to those of ordinary skill in the art from a review of the following detailed description when considered in conjunction with the drawings.

BRIEF DESCRIPTION OF THE DRAWINGS

Reference will now be made, by way of example, to the accompanying drawings which show example embodiments, and in which.

Similar reference numerals are used in different figures to denote similar components.

DESCRIPTION OF SPECIFIC EMBODIMENTS

Figure 1:
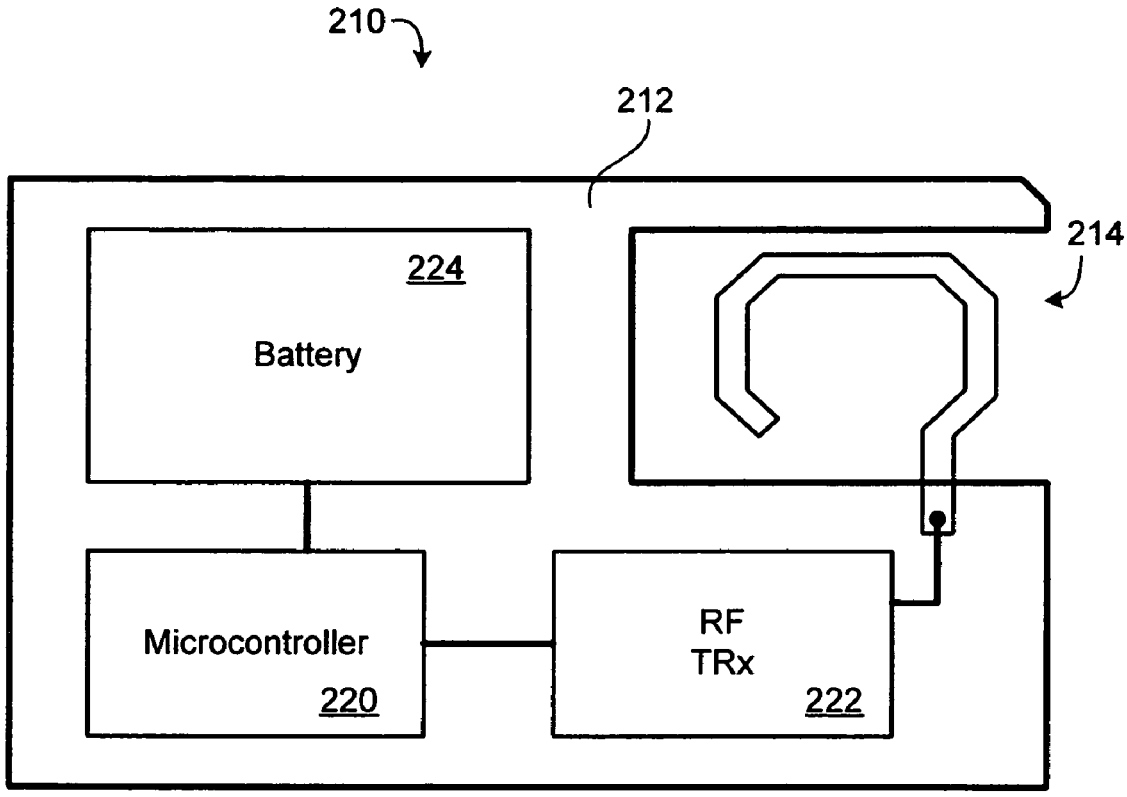
PRIOR ART FIG. 1
FIG. 1 diagrammatically shows, in plan view, a known ETC transponder.

Reference is first made to FIG. 1, which diagrammatically shows, in plan view, a known ETC transponder 210. The transponder 210 includes an antenna 214, a ground plane 212, a microcontroller 220, an RF transceiver 222, and a battery 224. The battery 224 supplies DC power to the microcontroller 220 and the RF transceiver 222. The microcontroller 226 operates under stored program control and implements an RF communications protocol for engaging in ETC transactions with remote readers. The RF transceiver 222 performs the demodulation of RF signals received through the antenna 214 and related signal-reception operations. It also generates modulated RF signals and performs related operations for excitation of the antenna 214 so as to propagate RF signals to a remote reader. The ETC transponder 210 may operate in accordance with any of a number of proprietary or standard communications protocols for engaging in electronic toll transactions in association with vehicles, as will be appreciated by those of ordinary skill in the art. The function and operation of the ETC transponder 210 and its various components will be familiar to those skilled in the art, so these aspects of the ETC transponder 210 will not be explained in detail herein.

Figure 2:
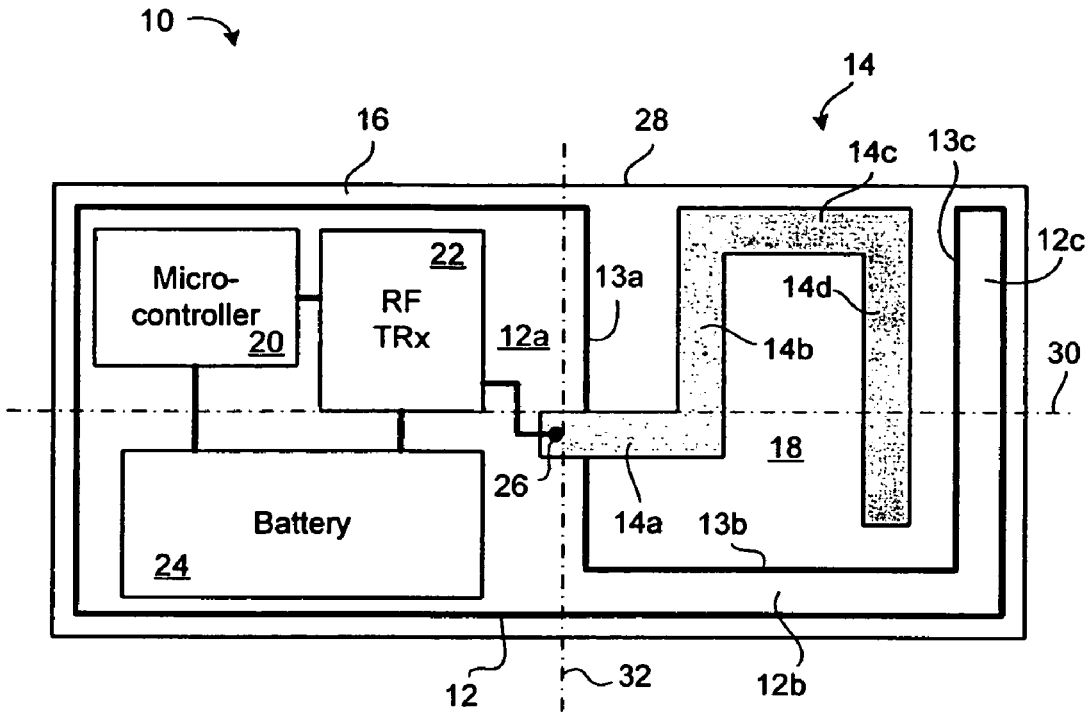
FIG. 2 shows, in block diagram form, a plan view of an ETC transponder, configured in accordance with the present application.

Reference is now made to FIG. 2, which shows, in block diagram form, a plan view of an ETC transponder 10, configured in accordance with the present application. The ETC transponder 10 includes an antenna 14, a ground plane 12, a microcontroller 20, an RF transceiver 22, and a battery 24.

The components of the ETC transponder 10 are mounted or disposed upon a circuit substrate 16. In FIG. 2 the circuit substrate 16 is shown as having dimensions that extend beyond the edges of the ground plane 12 for ease of illustration; however, in some embodiments, some edges of the ground plane 12 may be coterminous with the edges of the circuit substrate 16. The techniques and options for mounting circuit components, such as the ground plane 12, the microcontroller 20, etc., upon a substrate material are within the understanding of a person skilled in the area of circuit design and manufacturing, as is the selection of a suitable substrate material.

The ground plane 12 is arranged and configured so as to leave a blank section or area, indicated by reference number 18, which may be referred to as the antenna space 18. The antenna 14 is formed in an antenna pattern and is disposed within the antenna space 18.

In the embodiment shown in FIG. 2, the ground plane 12 is made up of at least three portions (labeled individually as 12*a*, 12*b*, and 12*c*). Portion 12*b* interconnects portions 12*a* and 12*c* so as to define the antenna space 18. In at least one embodiment, portion 12*a* includes an edge 13*a* defining one side of the antenna space 18, portion 12*b* includes an edge 13*b* defining a second side of the antenna space 18, and portion 12*c* includes an edge 13*c* defining a third side of the antenna space 18. In at least one embodiment, the edges 13*a*, 13*b*, 13*c* are straight edges. In one embodiment, the straight edges 13*a*, 13*b*, and 13*c* are joined at right angles, so as to define a rectangular antenna space 18.

The portion 12*a* of the ground 12 is the largest section of ground 12. As will be appreciated by those of ordinary skill in the art, the portion 12*a* may be deposited or formed on the circuit substrate 16 so as to surround the circuit components and their interconnections, so as to cover a substantial portion of the circuit substrate 16 and thereby providing as "infinite" a ground plane as space will allow on the circuit substrate 16.

In the embodiment illustrated in FIG. 2, the portion 12*b* of the ground plane 12 and the portion 12*c* of the ground plane 12 are generally rectangular sections. The widths of portions 12*b* and 12*c* impact the antenna beam shape and direction, meaning that adjustments to the widths of these portions 12*b* and 12*c* can be made to steer and shape the antenna beam in a desired direction or pattern. The portions 12*b* and 12*c* may, in one embodiment, have a width substantially similar to the width of the antenna 14 radiating arm; however, in many embodiments the width of these portions 12*b* and 12*c* may be different from the width of the radiator arm. In some cases, the portions 12*b* and 12*c* may have differing widths as between themselves.

The antenna 14 is arranged within the antenna space 18 to form an antenna pattern. The antenna 14 may be connected to a feed point 26 that connects the antenna 14 to the RF transceiver 22. RF signals induced in the antenna 14 are coupled to the RF transceiver 22 through the feed point 26 and outgoing RF excitation signals generated by the RF transceiver 22 are coupled to the antenna 14 through the feed point 26.

The antenna 14, as shown in FIG. 2, may be formed from generally rectangular sections connected serially to form the antenna pattern. In the embodiment shown in FIG. 2, the antenna 14 includes a feed section 14*a*, a first section 14*b*, a second section 14*c*, and a third section 14*d*. The first section 14*b* is connected perpendicular to the feed section 14*a* and extends towards a longitudinal edge 28 of the circuit substrate 16. The second section 16*c* is connected perpendicular to the first section 14*b* and extends parallel to the longitudinal edge 28. The third section 14*d* is connected perpendicular to the second section 14*c* and extends in a direction away from the longitudinal edge 28. In this manner, the antenna 14 forms a meander-line antenna pattern.

The circuit substrate 16 includes a longitudinal axis, indicated using reference numeral 30. In some embodiments, the longitudinal axis 30 may pass through the antenna feed point 26 and/or the antenna feed section 14*a*, although this is not necessary. The antenna feed section 14*a* extends into the antenna space 18 perpendicular to the edge 13*a* of section 12*a* of the ground plane 12. In other words, the antenna feed section 14*a* extends parallel to the longitudinal axis 30. In this sense, the antenna 14 may be said to have an antenna axis parallel to the longitudinal axis 30, i.e. extending in a longitudinal direction.

A transverse axis 32 may be defined on the circuit substrate 16, wherein the transverse axis 32 is perpendicular to the longitudinal axis 30. In one sense, the transverse axis 32 divides the transponder 10 into a circuit part and an antenna part. The circuit part is that portion of the transponder 10 on one side of the transverse axis 32 that includes the circuit components, such as the microcontroller 20, the RF transceiver 22, and the battery 24. The antenna part is that portion of the transponder 10 on the other side of the transverse axis 32 that includes the antenna 14, and the portions 12*b* and 12*c* of the ground plane 12 that serve to define the antenna space 18.

The inventors of the present invention have found that by co-locating the circuit components within the circuit part on the one side of the transverse axis 32, and by placing the antenna 14 in an antenna space 18 formed on the other side of the transverse axis 32, improvements in the radiation pattern and sensitivity of the antenna 14 can be realized through the resulting reduction in interference by the circuit components. In particular, by positioning the battery 24 on the circuit substrate 16 in a location remote from the antenna 14 and on the opposite side of the transverse axis 32 from the antenna 14, the sensitivity of the transponder 10 may be improved and the sharpness of the cutoff of the radiation pattern at the edges may be improved. Accordingly, the same capture zone may be realized with heightened sensitivity and a smaller overall transponder, requiring less circuit board space.

Figure 3:
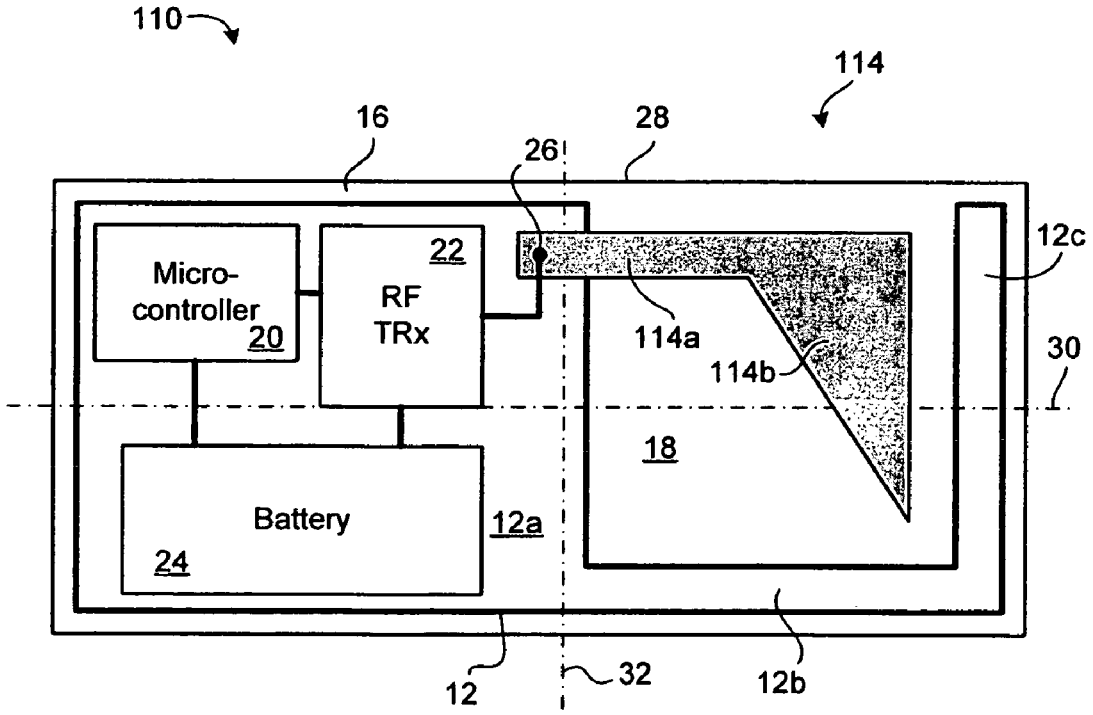
FIG. 3 shows, in block diagram form, a plan view of another ETC transponder, configured in accordance with the present application.
Figure 4:
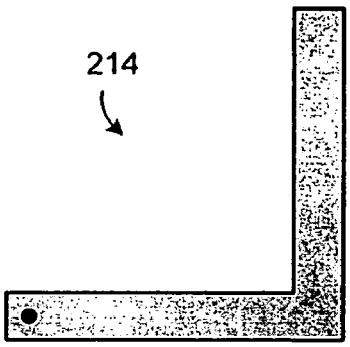
FIGS. 4, 5, 6, and 7 diagrammatically show example antennas.
Figure 5:
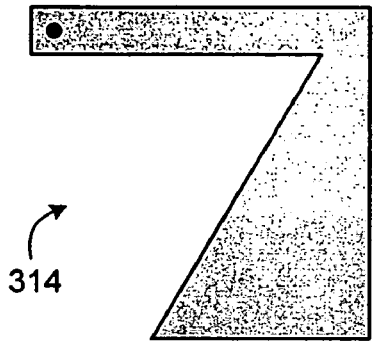
Figure 6:
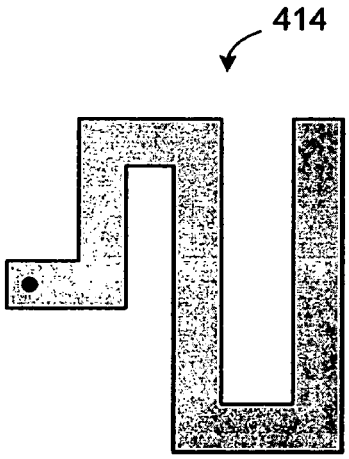
Figure 7:
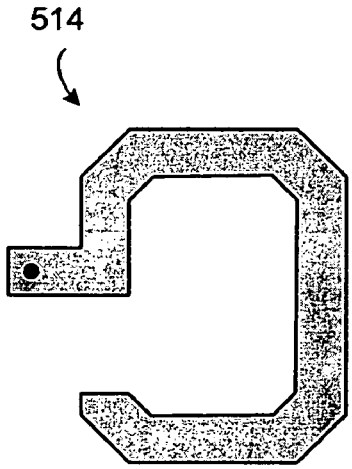

Reference is now made to FIG. 3, which shows, in block diagram form, a plan view of an ETC transponder 110, configured in accordance with the present application. The ETC transponder 110 includes the microcontroller 20, the RF transceiver 22, the battery 24 and the ground plane 12. The ground plane 12 defines the antenna space 18 with sections 12*a*, 12*b*, and 12*c*.

The ETC transponder 110 is substantially the same as the ETC transponder 10 depicted in FIG. 2, except that the ETC transponder 110 has an antenna 114 with a different antenna pattern.

The antenna 114 includes an antenna feed section 114*a* connected to the feed point 26 and extending into the antenna space 18 in a longitudinal direction. The antenna 114 also includes a triangular section 114*b* connected to the antenna feed section 114*a* and extending in a transverse direction. It will be appreciated that this antenna pattern will provide a different radiation pattern and will have a different sensitivity than the radiation pattern produced by the antenna 14 shown in FIG. 1.

Other embodiments of ETC transponders in accordance with the present application may feature other antenna patterns. By way of example, reference is made to FIGS. 4, 5, 6, and 7, which diagrammatically show example antennas 214, 314, 414, and 514, respectively.

The present invention may be embodied in other specific forms without departing from the spirit or essential characteristics thereof. Certain adaptations and modifications of the invention will be obvious to those skilled in the art. Therefore, the above discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A transponder for use in an electronic toll collection (ETC) system, the transponder operating using radio frequency (RF) signals, the transponder comprising:

a circuit substrate having a longitudinal axis and having a transverse axis perpendicular to the longitudinal axis;

a ground plane formed on the circuit substrate;

a planar antenna formed on the circuit substrate;

an RF transceiver connected to the antenna for receiving RF signals from the ETC system and for sending RF signals to the ETC system;

a controller for controlling the RF transceiver in accordance with an ETC communication protocol; and a battery for supplying DC power to the controller and the RF transceiver, wherein the antenna is disposed on one side of the transverse axis and the controller, the battery, and the RF transceiver are disposed on the other side of the transverse axis, wherein the antenna is arranged in an antenna pattern, and wherein the ground plane includes at least three connected segments and is disposed on at least three sides of the antenna pattern.

2. The transponder claimed in claim 1, wherein said at least three connected segments define an antenna space, within which said antenna is disposed.

3. The transponder claimed in claim 2, wherein said antenna space is rectangular.

4. The transponder claimed in claim 1, wherein said at least three segments include a first segment, a second segment, and a third segment, and wherein said first segment substantially surrounds the RF transceiver, the controller, and the battery, and wherein said second segment interconnects said first segment and said third segment to define an antenna space.

5. The transponder claimed in claim 4, wherein said antenna includes an antenna feed section, and wherein said antenna feed section is coupled to said RF transceiver through a feed point, and wherein said antenna feed section extends longitudinally into said antenna space.

6. The transponder claimed in claim 4, wherein said antenna includes a radiator arm having a width, and wherein the width of said second segment and said third segment is substantially the same as the width of said antenna.

7. The transponder claimed in claim 4, wherein said first segment, said second segment, and said third segment each have at least one straight edge, and wherein said straight edges define said antenna space.

8. The transponder claimed in claim 7, wherein said straight edges are joined at right angles such that they define a rectangular antenna space.

9. The transponder claimed in claim 8, wherein said antenna includes a radiator arm formed from a plurality of substantially rectangular sections in a meander-line pattern, and wherein each of said substantially rectangular sections is spaced apart from and parallel to at least one of said straight edges.

10. The transponder claimed in claim 1, wherein said antenna pattern comprises a meander-line pattern.

11. The transponder claimed in claim 10, wherein said antenna includes an antenna feed section, and a radiator arm, and wherein said radiator arm includes a first section, a second section, and a third section connected serially, and wherein said antenna feed section and said second section extend parallel to said longitudinal axis, and said first section and said third section extend parallel to said transverse axis.

12. The transponder claimed in claim 10, wherein said at least three connected segments define an antenna space, within which said antenna is disposed.

13. The transponder claimed in claim 12, wherein said antenna includes an antenna feed section, and wherein said antenna feed section is coupled to said RF transceiver through a feed point, and wherein said antenna feed section extends longitudinally into said antenna space.

14. The transponder claimed in claim 10, wherein said antenna is disposed along an antenna axis, and wherein said antenna axis extends parallel to said longitudinal axis.

15. The transponder claimed in claim 10, wherein said at least three segments include a first segment, a second segment, and a third segment, and wherein said first segment substantially surrounds the RF transceiver, the controller, and the battery, and wherein said second segment interconnects said first segment and said third segment to define an antenna space, and wherein said antenna is disposed within said antenna space.

16. A transponder for use in an electronic toll collection (ETC) system, the transponder operating using radio frequency (RF) signals, the transponder comprising:

a circuit substrate having a longitudinal axis and having a transverse axis perpendicular to the longitudinal axis;

a ground plane formed on the circuit substrate;

a planar antenna formed on the circuit substrate, wherein said antenna is disposed along an antenna axis, and wherein said antenna axis extends parallel to said longitudinal axis;

an RF transceiver connected to the antenna for receiving RF signals from the ETC system and for sending RF signals to the ETC system;

a controller for controlling the RF transceiver in accordance with an ETC communications protocol; and a battery for supplying DC power to the controller and the RF transceiver, wherein the antenna is disposed on one side of the transverse axis and the controller, the battery, and the RF transceiver are disposed on the other side of the transverse axis, wherein the antenna is arranged in an antenna pattern, and wherein the ground plane includes at least three connected segments and is disposed on at least three sides of the antenna pattern.

17. A transponder for use in an electronic toll collection (ETC) system, the transponder operating using radio frequency (RF) signals, the transponder comprising:

a circuit substrate having a longitudinal axis and having a transverse axis perpendicular to the longitudinal axis;

a ground plane formed on the circuit substrate and defining an antenna space having ground segments on at least three sides;

a meander-line antenna formed on the circuit substrate within the antenna space and having a longitudinal antenna axis; and a plurality of circuit components mounted on the circuit substrate for implementing an ETC communications protocol, the circuit components being connected to the antenna for receiving the RF signals, demodulating the RF signals, and exciting the antenna to propagate a response signal, wherein the antenna is disposed on one side of the transverse axis and the plurality of circuit components are disposed on the other side of the transverse axis.

18. The transponder claimed in claim 17, wherein said longitudinal antenna axis extends parallel to said longitudinal axis.

19. The transponder claimed in claim 17, wherein said ground segments include a first segment, a second segment, and a third segment, and wherein said first segment substantially surrounds the RF transceiver, the controller, and the battery, and wherein said second segment interconnects said first segment and said third segment to define said antenna space.

20. The transponder claimed in claim 19, wherein said first segment, said second segment, and said third segment each have at least one straight edge, wherein said straight edges are joined at right angles such that they define a rectangular antenna space, and wherein said antenna includes a radiator arm formed from a plurality of substantially rectangular sections in a meander-line pattern, and wherein each of said substantially rectangular sections is spaced apart from and parallel to at least one of said straight edges.

* * * * *

UNITED STATES PATENT AND TRADEMARK OFFICE

CERTIFICATE OF CORRECTION

PATENT NO. : 7,342,500 B2
APPLICATION NO. : 11/388737
DATED : March 11, 2008
INVENTOR(S) : Ho et al.

It is certified that error appears in the above-identified patent and that said Letters Patent is hereby corrected as shown below:

On the Cover Page item [75] "Inventors:"

-- after "Thua Van Ho, Mississauga (CA);" and after "Wai-Cheung Tang, Mannheim (CA);" insert -- "Mike Lee, Cambridge (CA)." --

Signed and Sealed this

Twenty-fourth Day of February, 2009

John Doll

JOHN DOLL
*Acting Director of the United States Patent and Trademark Office*